US008127653B2

(12) United States Patent
Giebels et al.

(10) Patent No.: US 8,127,653 B2
(45) Date of Patent: Mar. 6, 2012

(54) DEVICE AND METHOD FOR BRAIDING FIBERS INTO A BRAIDED STRUCTURE

(75) Inventors: Marc Marinus Johannes Leonardus Giebels, Geldrop (NL); Haro Egbert Georg Roderik Van Panhuys, Hertogenbosch (NL)

(73) Assignee: Wesp Holding B.V., Eindhoven (NL)

( * ) Notice: Subject to any disclaimer, the term of this patent is extended or adjusted under 35 U.S.C. 154(b) by 206 days.

(21) Appl. No.: 12/677,207

(22) PCT Filed: Sep. 12, 2008

(86) PCT No.: PCT/NL2008/050597

§ 371 (c)(1), (2), (4) Date: Apr. 7, 2010

(87) PCT Pub. No.: WO2009/035327

PCT Pub. Date: Mar. 19, 2009

(65) Prior Publication Data

US 2011/0005371 A1 Jan. 13, 2011

(30) Foreign Application Priority Data

Sep. 14, 2007 (EP) ..... 07116498

(51) Int. Cl.
*D04C 3/40* (2006.01)

(52) U.S. Cl. ..... 87/34

(58) Field of Classification Search ..... 87/33–51
See application file for complete search history.

(56) References Cited

U.S. PATENT DOCUMENTS

| | | | | |
|---|---|---|---|---|
| 1,188,741 | A * | 6/1916 | Dunkerley | 87/30 |
| 5,203,249 | A * | 4/1993 | Adams et al. | 87/34 |
| 6,679,152 | B1 | 1/2004 | Head et al. | |
| 2007/0186760 | A1 | 8/2007 | Masao | |

* cited by examiner

*Primary Examiner* — Shaun R Hurley
(74) *Attorney, Agent, or Firm* — The Webb Law Firm, PC

(57) ABSTRACT

The invention relates to a device for braiding fibers into a braided structure, the device comprising a braiding machine, comprising a continuous track plate, a forming device, comprising a forming ring, a braiding mandrel about which the braiding machine braids at least one layer of the braided structure, and positioning means to effectuate relative movement of the mandrel and the braiding machine during braiding. The continuous track plate and/or the forming ring are build up of at least two parts that may be separated and reattached to each other, the parts being arranged such as to allow the track plate and/or the forming ring to enclose the mandrel. The invention further relates to a method for braiding fibers into a braided structure.

17 Claims, 7 Drawing Sheets

DEVICE AND METHOD FOR BRAIDING FIBERS INTO A BRAIDED STRUCTURE

BACKGROUND OF THE INVENTION

1) Field of the Invention

The present invention relates to a device and method for braiding fibers into a braided structure, in particular a multi-layered braided structure.

2) Description of the Related Art

Such braided structures may be used as such, but are preferably used to form the reinforcing core of a fiber reinforced plastic product. To produce such a product, the braided structure is typically positioned in a mold and a resin is injected into this mold, and subsequently cured. This procedure is used in particular in the case of a fiber reinforced plastic with a high fiber content, typically more than 60% by volume. Fiber reinforced plastic products created in this way combine a high strength with low weight, and are used in aviation and aerospace applications for instance. A further possible use is in automobile construction.

A braided structure is typically manufactured using a system of equipment including a braiding machine, a forming device, including a forming ring, and a take-up device. The braiding machine consists of a track plate, onto which a plurality of yarn carriers is positioned. The yarn carriers carry the spools of yarn and may use tension controls to release the yarn during processing. Half of the yarn carriers are driven in a clockwise direction and half are driven in a counterclockwise direction. The movement of carriers is guided by the track plate that causes the two sets of opposing carriers to travel in a Maypole fashion around carrying yarns that extend perpendicular to the plane of the braiding machines track plate. At the point where the yarns consolidate to form the braid (frequently referred to as the braid point), a forming device is often used to control the dimension and shape of the braided fabric. Traditionally, the forming device comprises a forming ring that controls the outside diameter of the finished braided product. The tension required to pull the yarn off of the carriers and to pull the finished braid is supplied by a take-up device. The take-up device applies the force by pulling on the finished braid.

On account of the lack of inherent stability of a braided structure, the latter is usually braided around a solid mandrel in the shape of the final product to be obtained. The mandrel controls the inside dimensions of the braided product. During the braiding operation, the mandrel and the braiding machine are moved in relation to each other in order to create a sheet like structure. The thickness of the braid may be controlled by varying the thickness of a braided layer or by providing a plurality of layers arranged on top of each other.

During the known braiding process, the braiding machine and forming ring enclose the mandrel, and the mandrel is translated in a more or less linear fashion through the braiding machine and forming ring. In this way, so called 2.5D products can be formed. Such products are linear or curvilinear in shape, but may vary in the lateral dimension along their axis.

There is a need however to be able to produce continuous braided structures. Continuous structures are endless structures, and therefore have no discernable beginning or end. Examples of such structures include frame like structures, such as car chassis body parts. Such frame like structures may have any 3-dimensional (3D) form, and may be doubly curved for instance. The known method of producing such structures is to braid a number of 2D or 2.5D structures, and assemble these to form the desired frame like structure. However, such a method requires the use of separate connecting parts, and is therefore time consuming and expensive. Particularly in the case of fiber reinforced plastic products, the connecting areas moreover represent weak spots in the product.

The object of the invention therefore is to provide a device and method for braiding fibers into a continuous braided structure, which structure does not need to be assembled.

SUMMARY OF THE INVENTION

This object is achieved by the device and method according to the invention. In particular a device for braiding fibers into a braided structure is provided, the device comprising:

- a braiding machine, comprising a track plate;
- a forming device, comprising a forming ring;
- a braiding mandrel about which the braiding machine braids at least one layer of the braided structure;
- positioning means to effectuate relative movement of the mandrel and the braiding machine during braiding;

wherein the track plate and/or the forming ring are build up of at least two parts that may be separated and reattached to each other, the parts being arranged such as to allow the track plate and/or the forming ring to enclose the mandrel. By providing a device according to the invention, it becomes possible to produce continuous (endless) braided structures in one time, without requiring assembly of braided parts. This has in particularly advantages when braiding with strong fibers, such as us in fiber reinforced composite products. Indeed, a product braided by the device and method of the invention does not show weak spots in the final composite product.

In a particularly preferred embodiment the device according to the invention is characterized in that the track plate and the forming ring are build up of at least two parts that may be separated and reattached to each other, the parts being arranged such as to allow the track plate and the forming ring to enclose the mandrel.

Although the device may be used to braid any braided structure, the device is particularly suitable for braiding continuous braided structures. To this end, the mandrel of the device is preferably continuous as well. The mandrel may also be build up of several interconnectable parts however. The known braiding device does not allow to braid continuous structures since there is no means to enclose a continuous (frame like) mandrel. This is the reason why continuous mandrels have not been used in the art up to now. The invention is based on the insight that 'dividing' the track plate and forming ring in at least two separable parts allows to use such mandrels.

There are numerous possibilities for 'dividing' the track plate and/or forming ring in at least two parts. The only requirement is that the 'division' should be such as to allow access of the mandrel to the inner side of track plate and/or forming ring. A preferred embodiment of the device according to the invention comprises a track plate and forming ring, build up of at least two parts, wherein the at least two parts comprise a common hinge construction and are separated by rotation around the hinge construction. Rotation may be around an axis perpendicular to the plane of the track plate (and forming ring), or around an axis lying in the plane of the track plate (and forming ring). Also preferred is a device wherein at least one of the at least two parts forms a separable section, which may be removed in a radial direction.

In still another preferred embodiment, the device according to the invention comprises a plurality of forming rings, build up of at least two parts that may be separated and reattached to each other, the parts being arranged such as to allow the forming rings to enclose the mandrel. Using at least two forming rings allows to braid in two directions (forward and backwards). This is advantageous since braiding several layers of fibers on top of each other in a particular section of the continuous mandrel is readily achieved.

The device according to the invention is equipped with positioning means to effectuate relative movement of the mandrel and the braiding machine during braiding. Positioning the mandrel relative to the braiding machine may be effectuated by any means known in the art. Suitable positioning means comprise driving rolls for instance. Such driving rolls may be placed in the heart of the (usually circular) track plate and act upon the circumferential surface of the mandrel. However there are numerous other possibilities at the disposition of the person skilled in the art. Even positioning by hand would be a possibility.

In a particularly preferred embodiment, the device according to the invention comprises positioning means, arranged to move the assembly of forming device and braiding machine about the mandrel, and keep the mandrel in a stationary position. A very suitable device according to the invention has positioning means in the form of a robotic guiding apparatus. Although it is customary in the state of the art to move the mandrel relative to a stationary braiding machine, the present embodiment surprisingly provides many advantages. First of all, this embodiment obviates the use of driving rolls to manipulate the mandrel. Such rolls have to be changed any time a mandrel with a different cross sectional shape is selected. The present embodiment does not have this disadvantage, since the assembly of forming device and braiding machine is not changed in shape. Secondly, moving the braiding machine and forming device about the mandrel can be carried out easier. All that is needed is to determine the neutral line of the mandrel and to steer the positioning means along this neutral line. With the neutral line of the mandrel is meant the line that interconnects the centers of gravity of all cross-sections of the mandrel. An additional advantage is that the mandrel need not to be manipulated. Mandrels for braiding products are usually made from a foam-like material, such as polystyrene foam. Such mandrels may break easily during manipulation. By keeping the mandrel in a stationary position, it is also easily supported, thereby further reducing the risk for breakage. It should be appreciated that the forces on the mandrel during braiding may be substantial. The above mentioned advantages of manipulating the assembly of forming device and braiding machine, and keeping the mandrel in a stationary position are particularly notable for more complex mandrel (and product) shapes, such as framelike products and framelike products with a 3-dimensional shape (doubly curved for instance).

More preferably, the device according to the invention comprises a forming device and braiding machine that are planar, as well as positioning means, arranged to move the assembly of forming device and braiding machine with their plane substantially perpendicular to the axis of the mandrel. This has the advantage that the tension force in the fibers is more even, and therefore a better product is made.

The device according to the invention is preferably characterized in that the mandrel is inflatable. Continuous braided products are difficult to transport, since by its very nature the mandrel usually remains inside the braided product. When using an inflatable mandrel, the mandrel can be inflated before actual braiding, remain in the inflated state during braiding and can be deflated again after braiding has been finished. The braided product is then pliable and may easily be transported. Although inflation is the preferred way to accomplish this goal, other methods may also be used, such as the use of sand-filled mandrels, foldable mandrels, and so on.

The invention also relates to a method for braiding fibers into a braided structure, the method being suitable in particular for use on the claimed device.

The method according to the invention aims at braiding fibers around a mandrel into a braided structure, and comprising the steps of:

- providing a braiding machine, comprising a track plate, and a forming device, comprising a forming ring, wherein the track plate and/or the forming ring are build up of at least two parts that may be separated and reattached to each other,
- separating the at least two parts and bringing the mandrel within the perimeter of the track plate and/or forming ring;
- reattaching the at least two parts of the track plate and/or the forming ring thereby enclosing the mandrel;
- braiding the braided structure in a number of layers onto the mandrel by moving the mandrel relative to the braiding machine;
- removing the braided structure by separating the at least two parts and bringing the structure out of the perimeter of the track plate and/or forming ring.

The method is particularly suitable for braiding continuous braided structures, in which method a continuous mandrel is preferably used. A particularly advantageous method according to the invention is characterized in that a plurality of forming rings, build up of at least two parts that may be separated and reattached to each other, is used. Another preferred embodiment of the invented method comprises moving the assembly of forming device and braiding machine about the mandrel, the mandrel being held in a stationary position. It further has advantages to use a method, wherein the mandrel is continuous, and the assembly of forming device and braiding machine is moved about the mandrel in the same direction several times to build up several braided layers. Another preferred embodiment of the method according to the invention is characterized in that the mandrel is continuous, and that differing numbers of braided fiber layers in different regions of the mandrel are created by reversing the movement of the assembly of forming device and braiding machine relative to the mandrel. It further has advantages to characterize the method according to the invention in that the mandrel is continuous, the forming device and braiding machine are planar, and the assembly of forming device and braiding machine is moved along the mandrel with their plane substantially perpendicular to the axis of the mandrel. Even more preferred is a method, wherein the assembly of forming device and braiding machine is moved along the mandrel such that the axis of the mandrel coincides with the heart line of the forming ring.

BRIEF DESCRIPTION OF THE DRAWINGS

The invention will now be explained in greater detail by means of the enclosed figures, without however being limited thereto. In the figures.

DETAILED DESCRIPTION OF THE PREFERRED EMBODIMENTS

Figure 1:
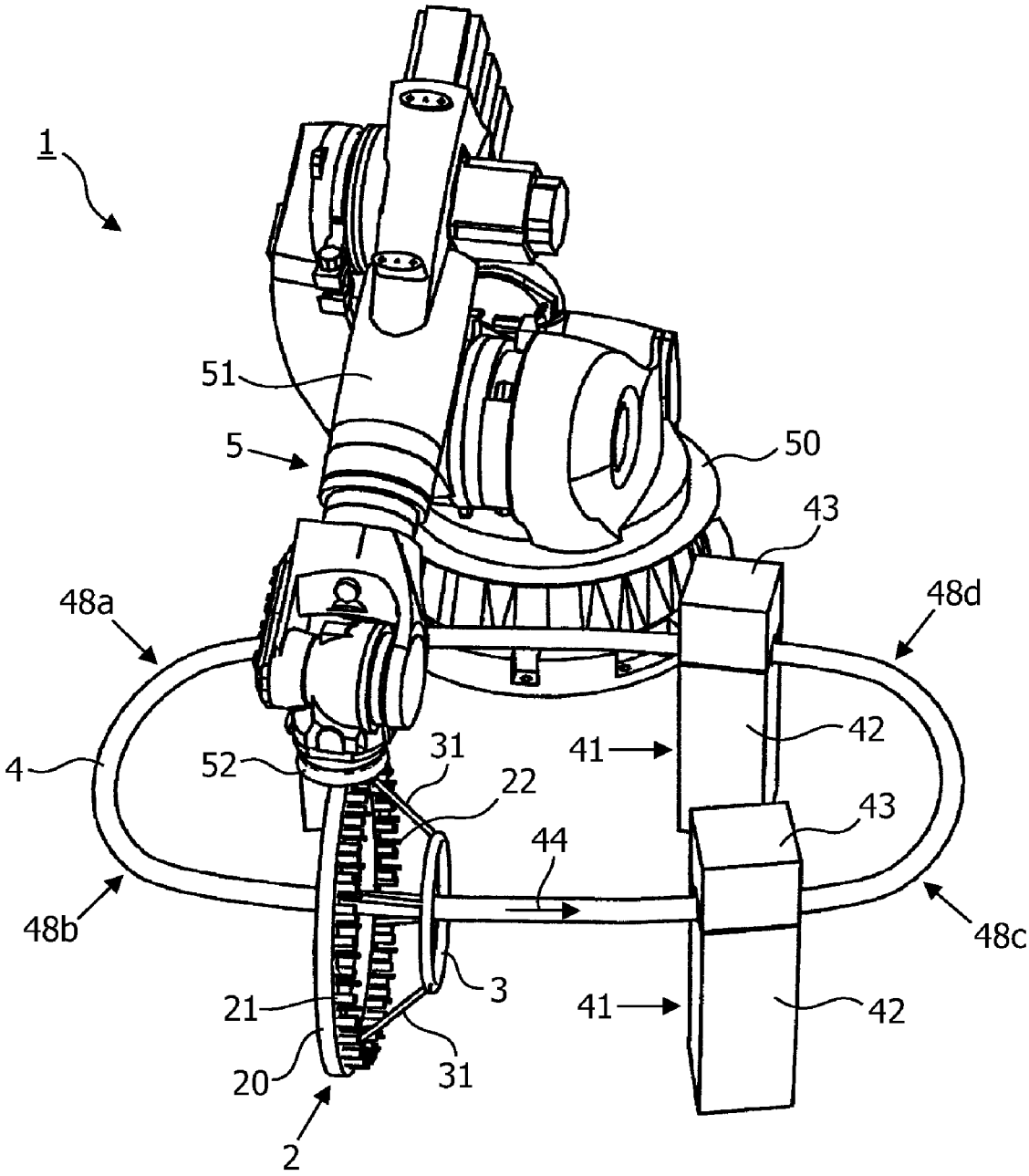
FIG. 1 schematically shows a perspective view of a braiding device in accordance with an embodiment of the present invention, FIG. 2 schematically shows a perspective view of the braiding device of FIG. 1 in another position.
Figure 3A:
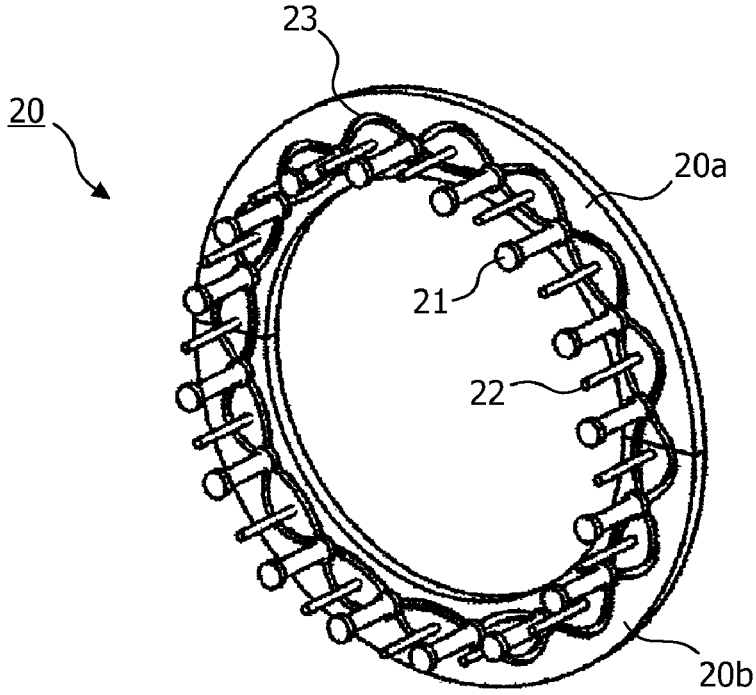
FIG. 3A schematically shows a view of the braiding machine according to the invention in closed position.
Figure 3B:
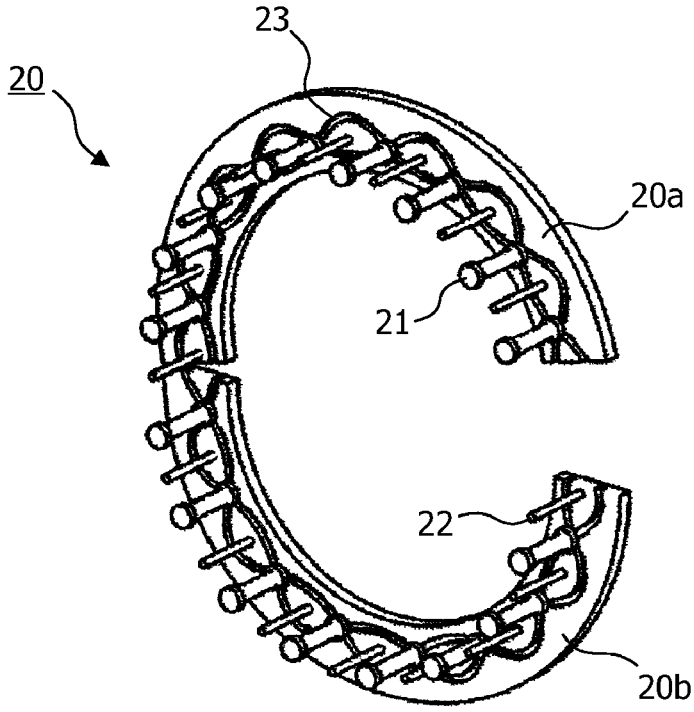
FIG. 3B schematically shows a view of the braiding machine of FIG. 3A in open position.
Figure 5A:
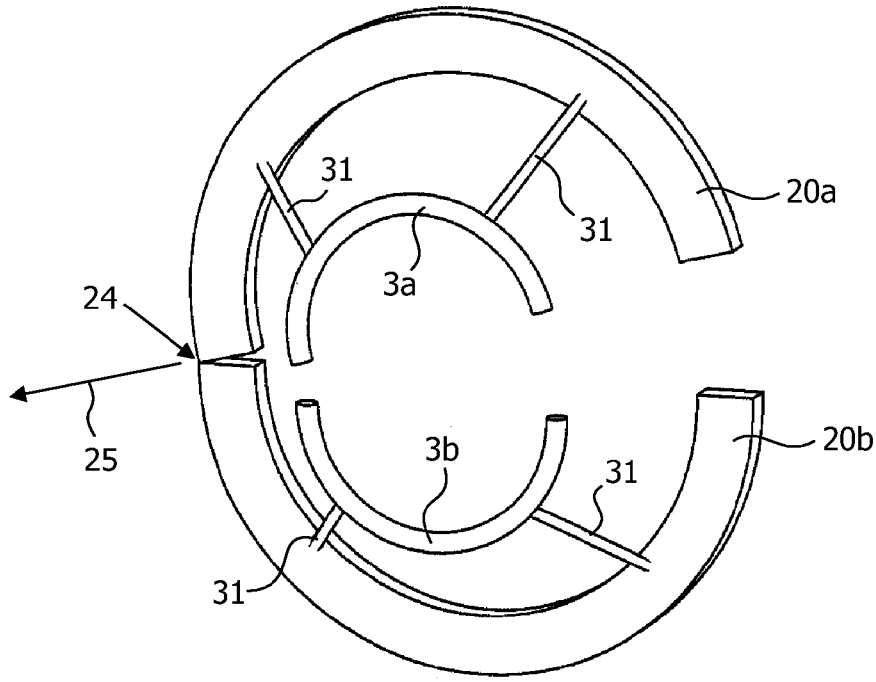
FIGS. 5A to 5D schematically shows several embodiments of the assembly of track plate and forming ring according to the invention.
Figure 5B:
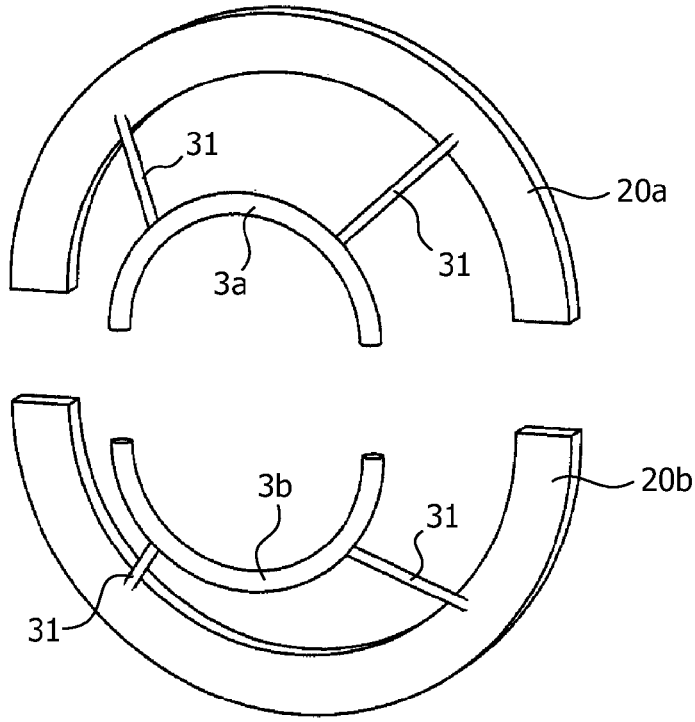
Figure 5C:
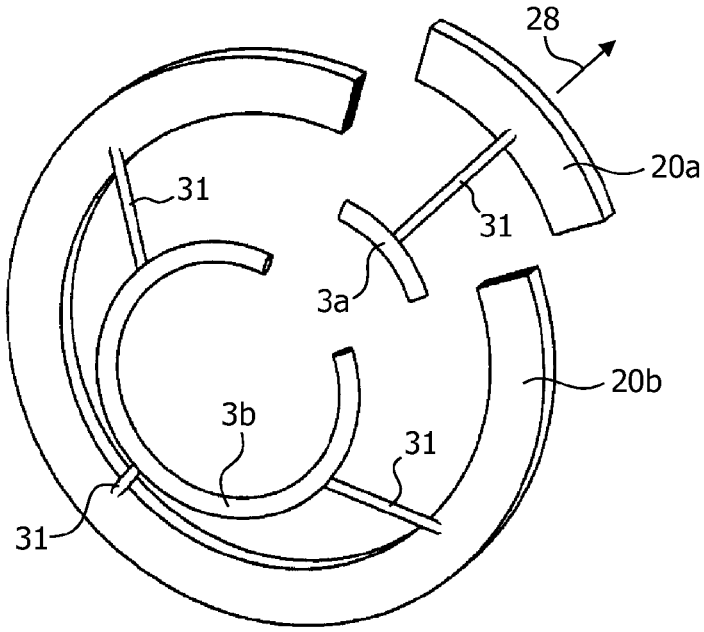
Figure 5D:
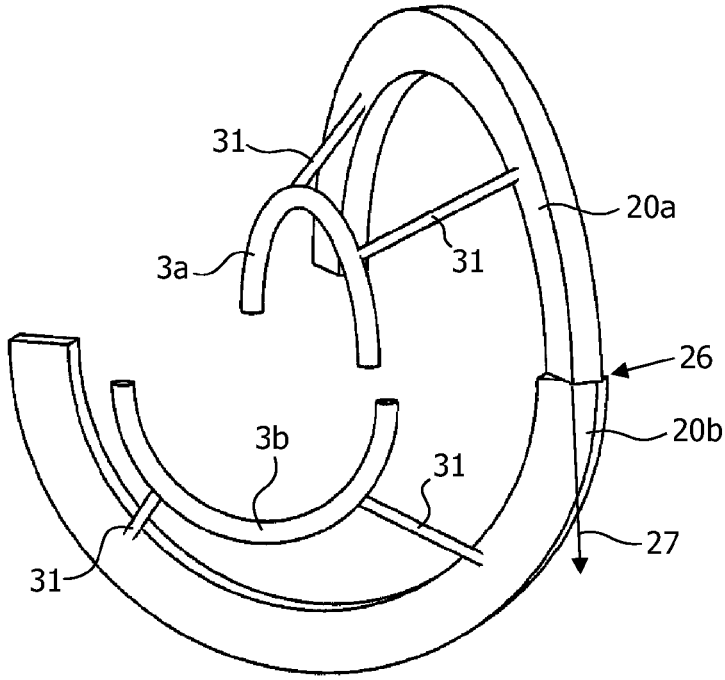

With reference to FIG. 1 a device 1 for braiding fibers (not shown) into a braided structure is shown. Device 1 comprises a braiding machine 2, a forming device in the form of a forming ring 3, a braiding mandrel 4 about which the braiding machine 2 braids layers of the braided structure, as well as positioning means 5 to effectuate relative movement of the mandrel 4 and the braiding machine 2 during braiding. Braiding mandrel 4 is continuous, i.e. has no beginning or end. The resulting braided product will likewise be continuous. Mandrel 4 consists of rigid foam, for instance foamed polystyrene. This also makes it possible for the braided layers to be penetrated and for them to be made to bear firmly against the mandrel by the needles. In a preferred embodiment, mandrel 4 is inflatable. In the embodiment shown the positioning means 5 comprise a robot, which is essentially build up of a turntable 50 around which a pivoting arm 51 can be rotated. Pivoting arm 51 is provided at the end of it with gripping means 52, meant to act upon braiding machine 2. Positioning means 5 are connected to a computer (not shown), which contains the data to steer the pivoting arm 51 and gripping means 52 along any desirable path. Continuous mandrel 4 is held in a stationary position by support means 41, which in the embodiment shown consist of two separable parts (42, 43), which parts (42, 43) are able to clamp the mandrel 4. The assembly of braiding machine 2 and forming ring 3 is manipulated by the positioning means 5 about the mandrel 4 along the path, as determined by the computer. Although in the embodiment shown mandrel 4 is held in a stationary position, it is also possible to move mandrel 4, if desired in combination with a movement of the assembly of braiding machine 2 and forming ring 3. The braiding machine 2 is known per se and usually comprises at least a continuous (planar) track plate 20, provided with a number of bobbin carriers 21 for the fibers that have to be braided in a direction transverse to the moving direction of mandrel 4 and/or braiding machine 2 (the longitudinal direction of the mandrel 4). The transverse braiding path 23 is schematically shown in FIG. 3A for instance. Track plate 20 also comprises guiding tubes 22 for fibers that run in the longitudinal direction. These fibers (not shown) are provided by a separate creel of bobbins (not shown) which may be positioned at a distance from the tracking plate 20. Forming ring 3 is usually attached to track plate 20 by support members 31. According to a preferred embodiment of the invention, continuous track plate 20 and forming ring 3 are build up of at least two parts (20*a*, 20*b*) and (3*a*, 3*b*) respectively that may be separated and reattached to each other, as is shown in detail in FIGS. 3A and 3B, and in FIGS. 5A to 5D. In FIGS. 5A to 5D, the bobbin carriers 21 and guiding tubes 22 have been omitted for clarity. FIG. 5A shows a preferred embodiment wherein parts (20*a*, 20*b*) and (3*a*, 3*b*) comprise a common hinge construction 24 and are separated by rotation around the hinge construction, such as to allow positioning of the mandrel 4 within the assembly of track plate 20 and forming ring 3. Rotation is effectuated around an axis 25 perpendicular to the plane of the track plate 20 (or forming ring 3). In another embodiment shown in FIG. 5D, parts (20*a*, 20*b*) and (3*a*, 3*b*) also comprise a common hinge construction 26, but are separated by rotation around an axis 27, lying in the plane of the track plate 20 (or forming ring 3). In still another preferred embodiment shown in FIG. 5B, access of mandrel 4 to the inner side of track plate 2 and forming ring 3 is provided by a track plate 20 and forming ring 3, build up of two parts (20*a*, 20*b*) and (3*a*, 3*b*), wherein the two parts (20*a*, 20*b*) and (3*a*, 3*b*) are separated by a linear translation. Still another preferred embodiment comprises one part (20*a*, 3*a*) that forms a separable section, which is removable in the radial direction 28, as shown in FIG. 5C. It will be appreciated that numerous other possibilities exist to enable access of mandrel 4 to the inner side of track plate 20 and forming ring 3.

Figure 4A:
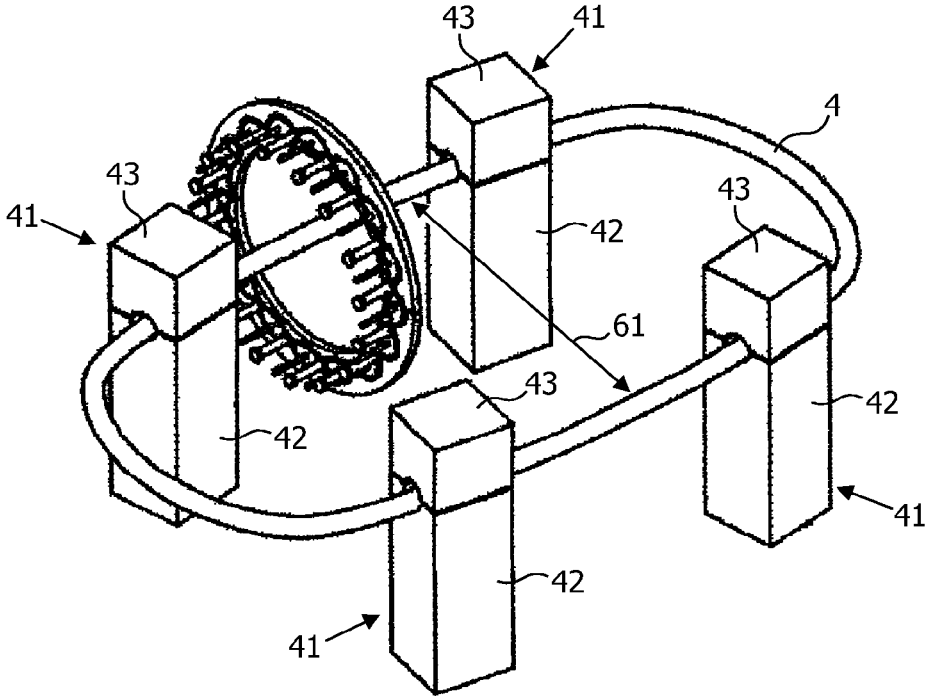
FIG. 4A schematically shows a view of part of the braiding device according to the invention in closed position.
Figure 4B:
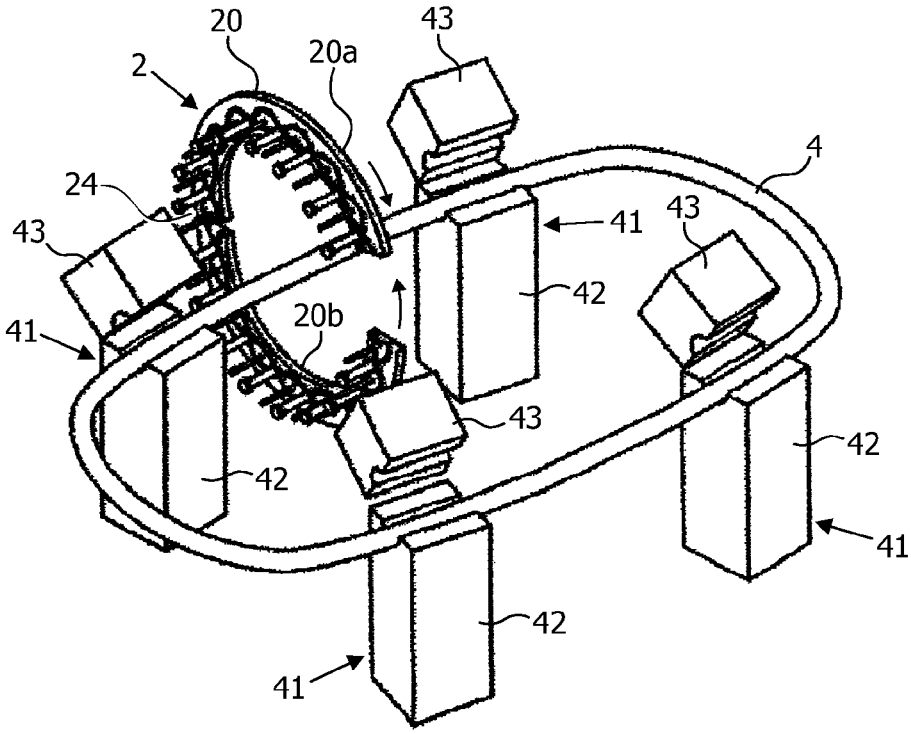
FIG. 4B schematically shows a view of the part of FIG. 3A in open position.

As schematically depicted in FIG. 4B, before starting the actual braiding operation, a continuous mandrel 4 is carefully positioned in support means 41, which, to this end have parts 42 and 43 in an open position. After placement of mandrel 4, parts (42,43) are closed thereby firmly clamping mandrel 4 in a fixed position, as shown in FIG. 4A. To be able to braid a continuous structure around mandrel 4, the braiding machine 2 is first opened by separating parts (20*a*, 20*b*) of track plate 20 and parts (3*a*, 3*b*) of forming ring 3. This position is shown in FIG. 4B, in which for clarity the forming ring 3 has been omitted. The braiding machine 2 is then brought in the vicinity of mandrel 4 by the robot (not shown) and positioned in a final position in which both parts (20*a*, 20*b*) and (3*a*, 3*b*) enclose mandrel 4, which then lies within the perimeter of the continuous track plate 20 and forming ring 3. The parts (20*a*, 20*b*) and (3*a*, 3*b*) are then brought to each other by rotating around hinge 24 in the direction depicted by the arrows in FIG. 4B. In this way, the braiding machine 2 is brought in the braiding position, in which it completely encloses mandrel 4, as shown in FIG. 4A.

Figure 2:
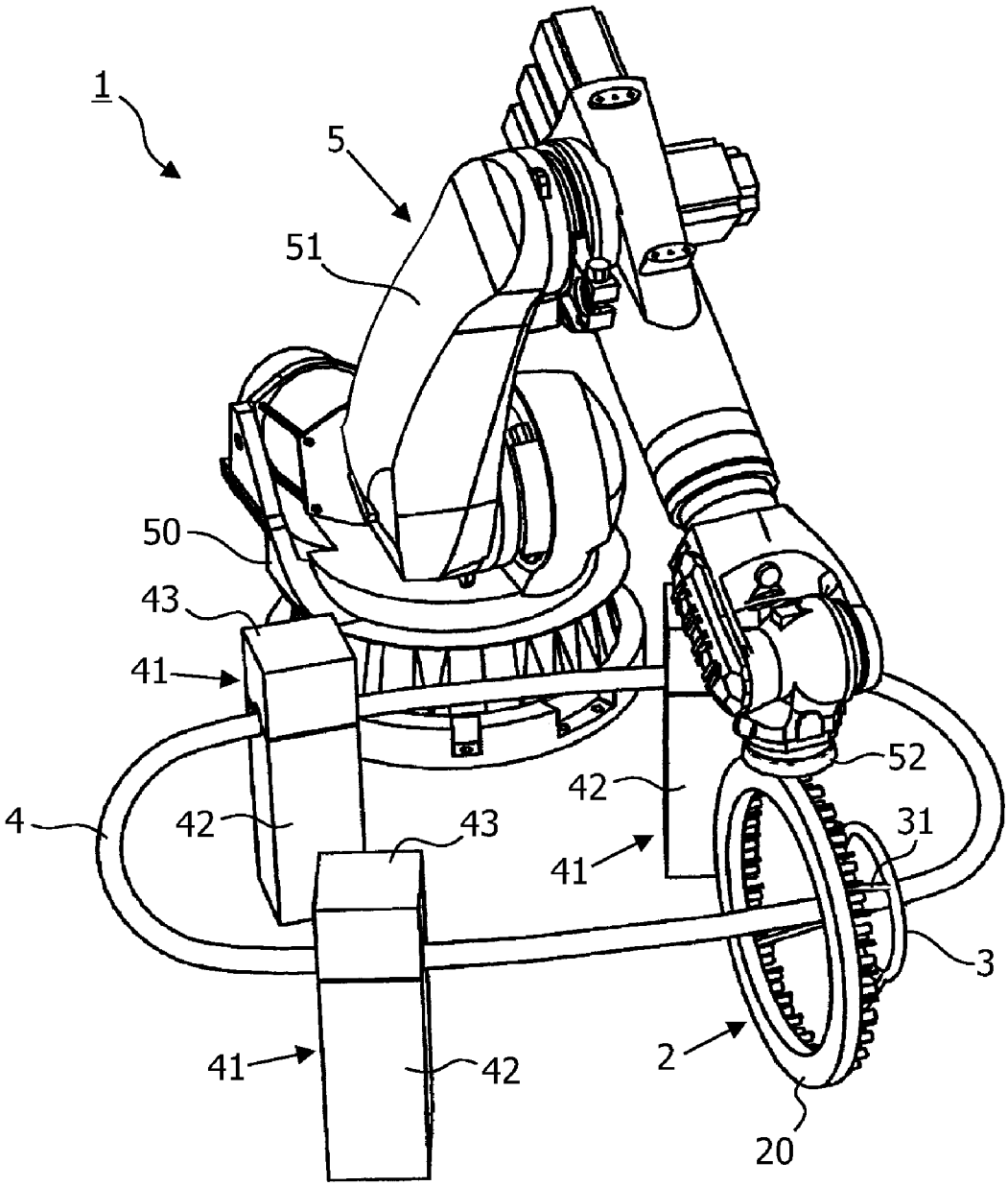

Braiding the braided structure in a number of layers onto the mandrel 4 is then carried out by moving the braiding machine 2 relative to mandrel 4. In this way the braiding machine 2 is moved from a position shown in FIG. 1, to a position shown in FIG. 2. To be able to completely cover the continuous mandrel 4, support means 41 are temporarily removed each time the braiding machine 2 passes such a support means. This removal may be accomplished automatically by two actuators preferably. The first actuator acts to separate part 43 from part 42. The second actuator acts to move part 42 away from the mandrel 4, thereby permitting unhindered passage of the braiding machine 2. In FIG. 1 the support means 41 on the left side has been temporarily removed, while in FIG. 2 the support means 41 on the left side has been replaced but the support means on the right side has been temporarily removed. In such way, there is always enough support for mandrel 4. The number of support means 41 may be increased when additional support of mandrel 4 is needed during braiding. During the braiding operation the positioning means 5 are preferably arranged to move the assembly of planar forming device 3 and braiding machine 2 with their plane substantially perpendicular to the longitudinal axis 44 of mandrel 4, as shown in FIG. 1 for instance. This means that in case mandrel 4 has a double curvature (in the figures a flat mandrel is shown) the assembly (2,3) is preferably rotated so as to remain perpendicular to axis 44. It is however also possible to position the assembly (2, 3) with an angle to the axis of mandrel 4. It further is preferred to move the assembly of forming device 3 and braiding machine 2 along mandrel 4, such that the geometric center of forming ring 3 follows the neutral line of mandrel 4. This is easily accomplished by suitably programming the computer that steers positioning means 5. It is much more difficult to do the reverse, i.e. to move mandrel 4 along the assembly of forming device 3 and braiding machine 2, such that the neutral line of mandrel 4 follows the geometric center of forming ring 3.

Figure 6A:
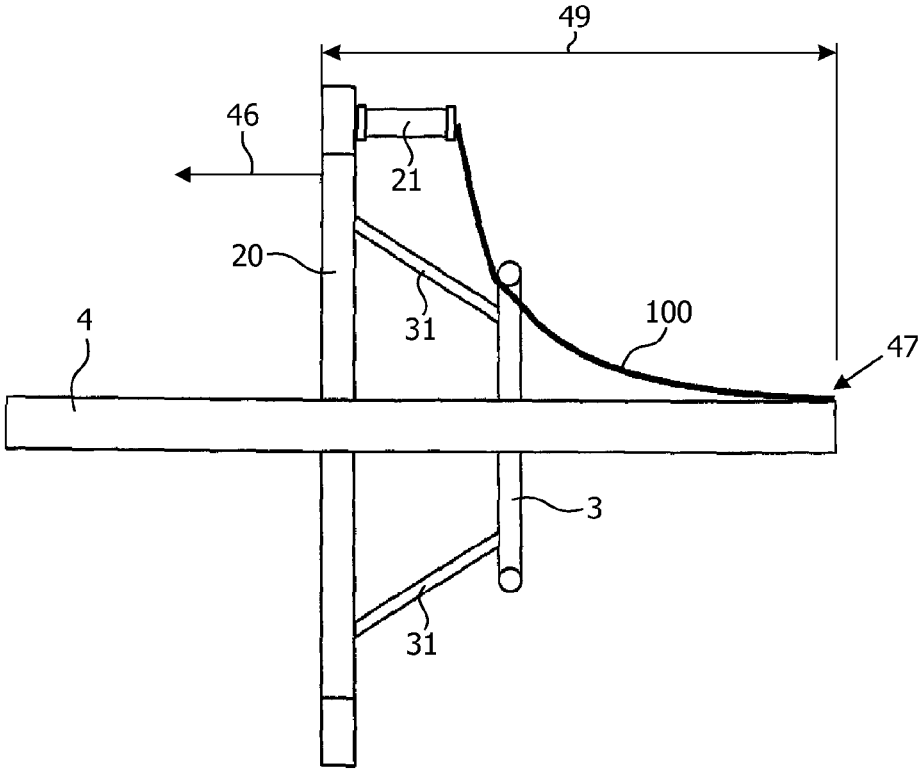
FIG. 6A schematically shows a side view of part of the braiding device according to the invention during forward braiding; and finally FIG. 6B schematically shows a side view of part of the braiding device according to the invention during backwards braiding.
Figure 6B:
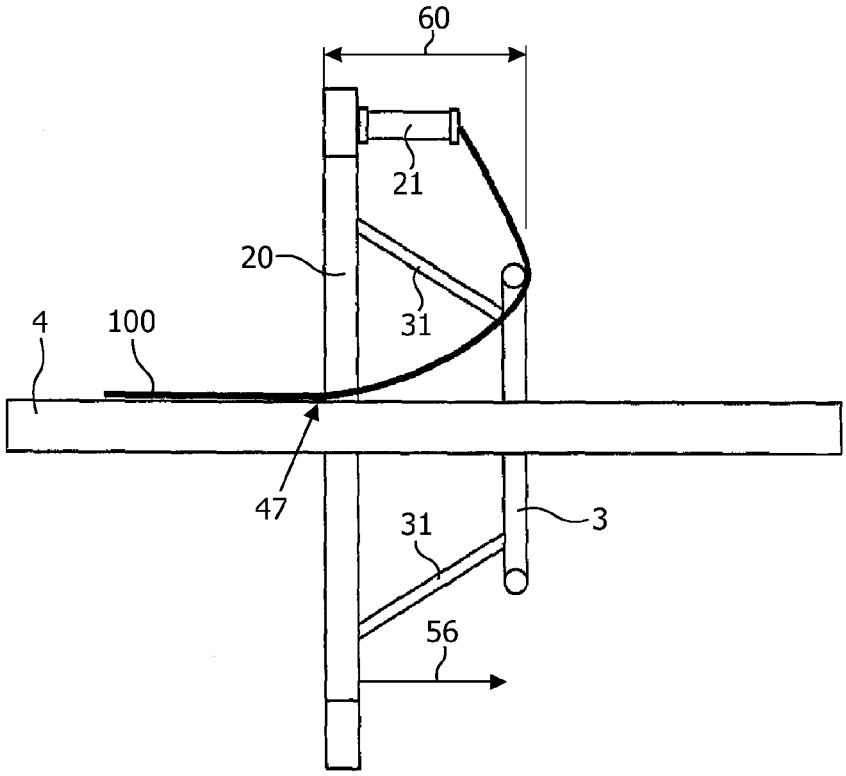

To build up several braided layers the assembly of forming device 3 and braiding machine 2 is moved about mandrel 4 in the same direction along several perimeter distances, the number of 'rounds' corresponding to the desired number of braided layers. With reference to FIGS. 6A and 6B two methods of braiding are schematically shown. In FIG. 6A a braid 100 (only partly shown) is formed by moving the assembly of track plate 20 and forming ring 3 in the direction 46, such that the track plate 20 leads the movement with respect to the stationary mandrel 4. The braid 100, originating from bobbin carrier 21, is guided by forming ring 3 and makes contact with mandrel 4 at a position 47, which is trailing behind with respect to the forming ring 3. With this method of braiding, continuous framelike structures can be readily braided, provided that these structures do not have small radii of curvature in the corners (48*a*, 48*b*, 48*c*, 48*d*, see FIG. 1) of the frame. Indeed the distance 49 between the track plate 20 and contact position 47 is relatively large, so that small radii of curvature are spanned. More importantly, the braiding machine 2 will not be able to follow mandrel 4 without getting stuck in the corner. For frames which do have relatively small radii of curvature in the corners 48 thereof, the preferred method of braiding is depicted in FIG. 6B. In the preferred method the assembly of track plate 20 and forming ring 3 is moved in the direction 56, such that the forming ring 3 leads the movement with respect to the stationary mandrel 4. As can be seen it is now possible to obtain a much smaller distance 60 between the forming ring 3 and contact position 47. Because of this smaller distance 60, it now becomes possible to braid continuous structures of smaller dimensions, for instance a smaller distance 61 between two opposite sides of the product (see FIG. 4A). An additional advantage of the device and method according to the invention is that reversal of movement of the braiding machine 2 and forming ring 3 is easily carried out by simple action of robotized positioning means 5. To this end, device 1 comprises a plurality of forming rings 3 (not shown). Each forming ring 3 is build up of at least two parts (3*a*, 3*b*) that may be separated and reattached to each other, the parts (3*a*, 3*b*) being arranged such as to allow forming rings 3 to enclose mandrel 4.

It is also possible to create differing numbers of braided fiber layers in different regions of mandrel 4 by reversing the movement of the assembly of forming device 3 and braiding machine 2 relative to mandrel 4. In the region of mandrel 4 that is passed over twice in this way, a doubled braided layer is consequently created, while other regions of the mandrel 4 may not be provided with a further braided layer at all as result of the reversal of the movement. This creates the possibility to increase the number of layers locally. The difficulty of this reversed braiding process is that the defined reversal point of the braided layer is to be created by a defined reversal edge. For this purpose, at the moment of the reversal of the movement of mandrel 4, the braided layer must be prevented from being displaced with respect to the latter, for instance by applying holding pins in the mandrel 4.

After the braiding operation is terminated, the braided structure, which now incorporates the mandrel 4, is removed by separating the two parts (20*a*, 20*b*) and (3*a*, 3*b*) and bringing the structure out of the perimeter of the continuous track plate 20 and forming ring 3.

In the exemplary embodiment described, the rigid foam mandrel 4 is braided with high strength carbon fibers. The multilayered fibrous braided structure created is then impregnated with a resin and cured in a downstream operation. In the braiding process the continuous mandrel 4 serves as an inner form carrier for the flexible braided structure. Since the mandrel is preferably continuous, i.e. has no beginning or end, it generally will constitute part of the final composite product in the envisaged application. In principle, however, (part of) the mandrel may also be removed from the finished product. The final composite product has increased strength and possibly also stiffness, due to the fact that the produced braid is continuous. To further increase strength the individual fibrous layers braided onto the rigid foam mandrel may be tufted, in order to interconnect them. On account of the material properties of the rigid foam mandrel, the tufting can be carried out before eventual removal of the mandrel, since the needles can penetrate into the rigid foam during the tufting.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A device for braiding fibers into a braided structure, the device comprising:

a braiding machine, comprising a continuous track plate;

a forming device, comprising a forming ring;

a braiding mandrel about which the braiding machine braids at least one layer of the braided structure;

positioning means to effectuate relative movement of the mandrel and the braiding machine during braiding;

wherein the continuous track plate and/or the forming ring are build up of at least two parts that may be separated and reattached to each other, the parts being arranged such as to allow the track plate and/or the forming ring to enclose the mandrel.

2. The device according to claim 1, wherein the continuous track plate and the forming ring are build up of at least two parts that may be separated and reattached to each other, the parts being arranged such as to allow the track plate and the forming ring to enclose the mandrel.

3. The device according to claim 1, wherein the braided structure and/or the mandrel is continuous.

4. The device according to claim 1, wherein the at least two parts comprise a common hinge construction and are separated by rotation around the hinge construction.

5. The device according to claim 1, the device comprising a plurality of forming rings, build up of at least two parts that may be separated and reattached to each other, the parts being arranged such as to allow the forming rings to enclose the mandrel.

6. The device according to claim 1, wherein the positioning means are arranged to move the assembly of forming device and braiding machine about the mandrel, the mandrel being in a stationary position.

7. The device according to claim 6, wherein the forming device and braiding machine are planar, and wherein the positioning means are arranged to move the assembly of forming device and braiding machine with their plane substantially perpendicular to the axis of the mandrel.

8. The device according to claim 1, wherein the positioning means comprise a robotic guiding apparatus.

9. The device according to claim 1, wherein the mandrel is inflatable.

10. A method of braiding fibers around a mandrel into a braided structure, the method comprising the steps of:

providing a braiding machine, comprising a continuous track plate, and a forming device, comprising a forming ring, wherein the continuous track plate and/or the forming ring are build up of at least two parts that may be separated and reattached to each other, separating the at least two parts and bringing the mandrel within the perimeter of the continuous track plate and/or forming ring;

reattaching the at least two parts of the continuous track plate and/or the forming ring thereby enclosing the mandrel;

braiding the braided structure in a number of layers onto the mandrel by moving the mandrel relative to the braiding machine;

removing the braided structure by separating the at least two parts and bringing the structure out of the perimeter of the continuous track plate and/or forming ring.

11. The method according to claim 10, wherein the braided structure and/or the mandrel is continuous.

12. The method according to claim 10, wherein a plurality of forming rings, build up of at least two parts that may be separated and reattached to each other, is used.

13. The method according to claim 10, wherein the assembly of forming device and braiding machine is moved about the mandrel, the mandrel being held in a stationary position.

14. The method according to claim 10, wherein the mandrel is continuous, and the assembly of forming device and braiding machine is moved about the mandrel in the same direction several times to build up several braided layers.

15. The method according to claim 10, wherein the mandrel is continuous, and differing numbers of braided fiber layers in different regions of the mandrel are created by reversing the movement of the assembly of forming device and braiding machine relative to the mandrel.

16. The method according to claim 10, wherein the mandrel is continuous, the forming device and braiding machine are planar, and wherein the assembly of forming device and braiding machine is moved along the mandrel with their plane substantially perpendicular to the axis of the mandrel.

17. The method according to claim 16, wherein the assembly of forming device and braiding machine is moved along the mandrel such that the axis of the mandrel coincides with the heart line of the forming ring.

* * * * *